United States Patent [19]

Albrecht et al.

[11] Patent Number: 4,593,597

[45] Date of Patent: Jun. 10, 1986

[54] PAGE-TURNING APPARATUS

[76] Inventors: Ernest E. Albrecht, 456 Glenmoor Rd.; Paul Cooper, 1429 Birch St., both of Canon City, Colo. 81212

[21] Appl. No.: 706,840

[22] Filed: Feb. 28, 1985

[51] Int. Cl.[4] ..... G10G 7/00

[52] U.S. Cl. ..... 84/487; 270/58

[58] Field of Search ..... 270/58; 84/486–487, 84/489, 500; 40/342, 343, 348, 354

[56] References Cited

U.S. PATENT DOCUMENTS

| | | | |
|---|---|---|---|
| 318,509 | 5/1885 | Sackett | 84/487 |
| 344,861 | 7/1886 | Richards, Sr. | 84/486 |
| 523,272 | 7/1894 | Ferrin | 84/487 |
| 1,132,682 | 3/1915 | Perez | 84/487 |
| 1,140,612 | 5/1915 | Retzler et al. | 84/486 X |
| 2,526,540 | 10/1950 | Carpenter | 84/487 |
| 4,031,644 | 6/1977 | Rogers | 84/487 X |
| 4,040,195 | 8/1977 | Claypool et al. | 84/487 X |
| 4,084,468 | 4/1978 | Butler | 84/500 |

*Primary Examiner*—E. H. Eickholt

*Attorney, Agent, or Firm*—Paul B. Fihe

[57] ABSTRACT

Disclosed herein is a page-turning apparatus which includes a platform which can rest on a piano music rack or the like and upon which a book, sheet music or the like can be supported. Regardless of its size, adjustable clamps are arranged to hold the book centered on the platform, and central page hold-down means are releasably urged against the opened pages. A movable member at one side of the platform can be actuated to frictionally engage and push a single page and during such page turning, correlated means are actuated to release the page hold-down means.

5 Claims, 4 Drawing Figures

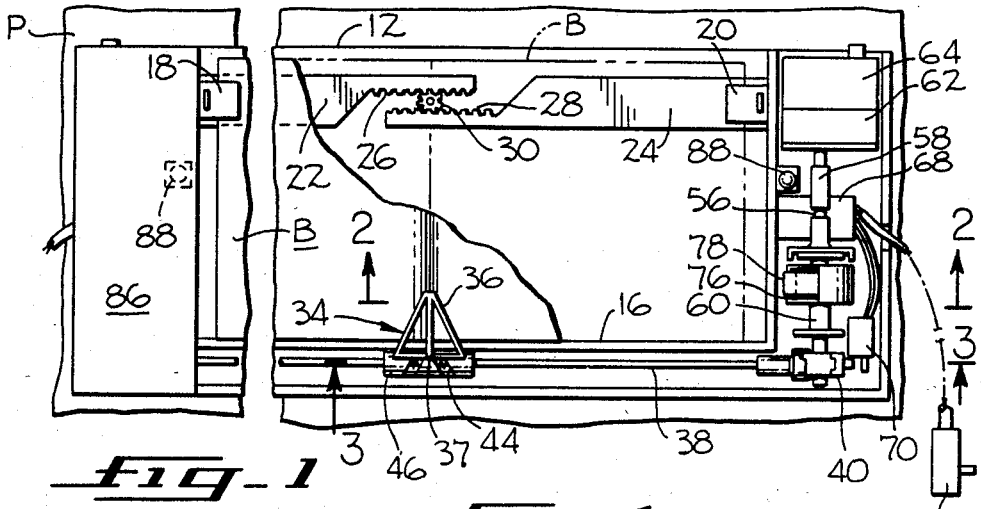
fig_1
fig_4
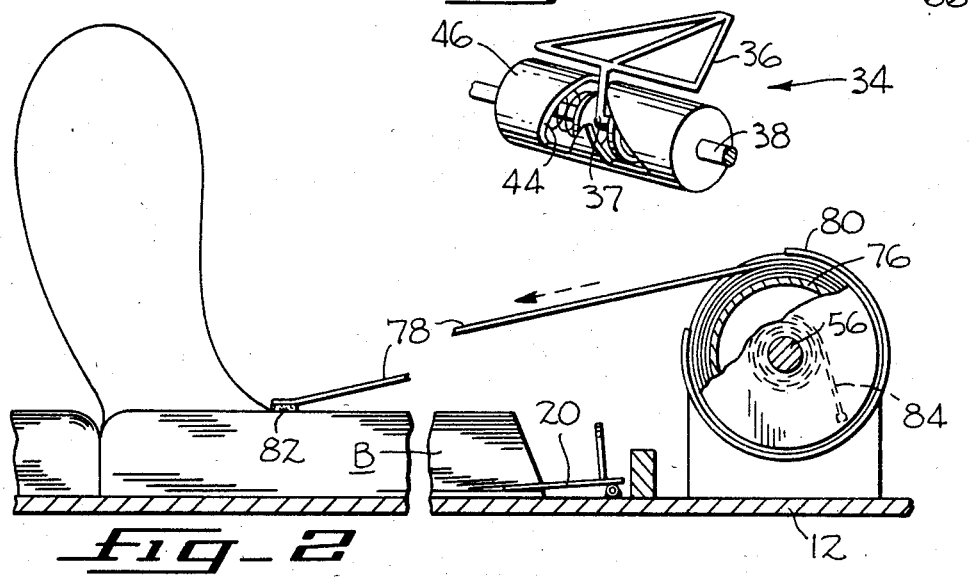
fig_2
fig_3
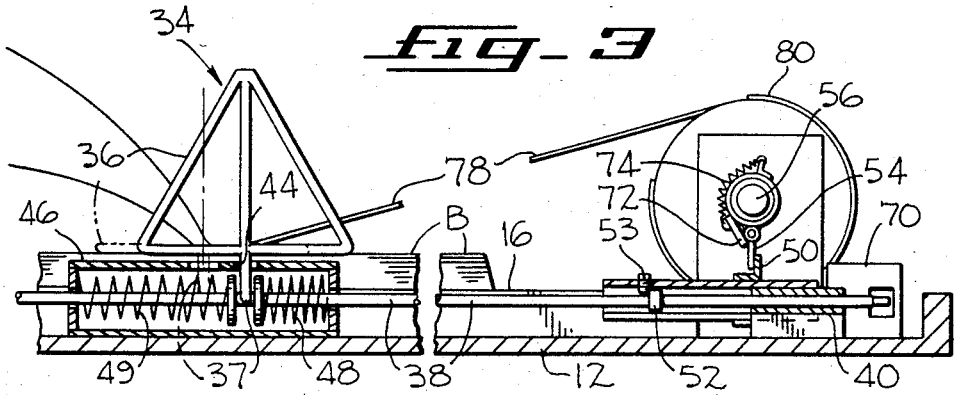

PAGE-TURNING APPARATUS

FIELD OF THE INVENTION

The present invention relates generally to page-turning apparatus and more particularly to manually-controlled, electrically-actuated apparatus for sequentially turning the pages of a book, sheet music or the like.

BACKGROUND OF THE INVENTION

When a pianist is playing a musical composition appearing on a multi-page sheet music, it is, of course, periodically necessary to manually turn the pages requiring, in turn, a brief, albeit significant, removal of the hands from the keyboard.

The problem is aggravated when a paraplegic or other manually-incapacitated individual wishes to turn the pages of, for example, a book.

Consequently, a number of automatic page-turning devices have been developed requiring but the depression of a foot pedal or other button which can be actuated in any fashion convenient to the particular user.

However, prior devices of this type have been quite complex, expensive and frequently non-effective.

SUMMARY OF THE PRESENT INVENTION

Accordingly, it is the general objective of the present invention to provide a relatively simple yet effective page-turning apparatus which can be actuated by selected manual contact to sequentially turn or re-turn the pages of a book, sheet music, or the like.

Briefly, to achieve such objective the page-turning apparatus includes a platform on which a book, sheet music or other unit having a plurality of pages may rest. The platform can be placed on the music rack of a piano or organ, a podium or other structure. Spring clamps engage releasably the front and rear covers of the book and can be laterally adjusted to accommodate books of various sizes and hold the selected book in a centered position on the platform.

Page hold-down means includes a member normally urged by springs into engagement with the adjacent pages of an opened book near its lower center to hold the pages flatly and provide visual access to the reader.

However, means under control of the reader can be energized to pivot the hold-down member away from page contact when a page-turning operation is instigated. More particularly, the hold-down member is preferably interconnected with a power means, preferably manually-actuated and electrically-energized, to move a page-turning member into frictional engagement with an exposed page of the book to instigate turning thereof. Momentary depression of a manual actuator (push button, foot pedal or the like) instigates the turning of a single page, first releasing the hold-down member from page contact, then establishing page engagement by the page-turning member, withdrawal of the member after the page has been moved past a central position and finally spring-urged return of the hold-down member into page contact to complete a single-page turning cycle. The latter action then deenergizes the power means until an additional manual actuation instigates the turning of the next page when desired by the reader.

The page-turning member and associated power means is located to the right of the book to effect forward turning of the page but, if desired, a similar (mirror-image) mechanism is mounted at the left side of the book on the platform to enable a re-turning of the book pages. The same hold-down member is interconnected with both the left and right mechanisms for similar functional release of the pages during either a turning or re-turning operation.

BRIEF DESCRIPTION OF THE DRAWINGS

The stated objective of the invention and the manner in which it is achieved, as summarized hereinabove, will be more fully understood by reference to the following detailed description of the exemplary embodiment of the invention shown in the accompanying drawings wherein:

FIG. 1 is a fragmentary elevational view of a page-turning apparatus mounted on a piano music rack and with portions broken away to show interior details, FIG. 2 is an enlarged fragmentary sectional view taken along line 2—2 of FIG. 1, but in an operative page-turning position.

FIG. 3 is a fragmentary sectional view taken along line 3—3 of FIG. 1, during a page-turning operation, and FIG. 4 is a fragmentary perspective view of a page hold-down member.

DETAILED DESCRIPTION OF THE EXEMPLARY EMBODIMENT OF THE INVENTION

With initial reference to FIG. 1, the turn-paging apparatus embodying the invention includes a platform 12 mounted on the music rack of a piano P although other platform supports can be used. A book, sheet music or the like indicated at B can be carried on the platform 12 so as to be visible to a reader, musician or other person, and a flange 16 adjacent the lower end of the platform engages the lower edge of the book to preclude sliding from the platform.

Adjacent its top lateral edges, both right and left, spring clamps 18, 20 are mounted to releasably engage the front and rear covers of the book to releasably hold the same in a centered position on the platform 12. To accommodate books of various dimensions, the spring clamps 18, 20 are mounted at the outer ends of slidable relatively flat bars 22, 24 which extend toward the center of the platform whereat opposed teeth 26, 28 on the inner ends of the bars engage opposite sides of a spur gear 30 rotably mounted on the platform 12. When one clamp 18 is manually moved, the other clamp 20 will be shifted an equal distance so that any book B, regardless of size, can be held centrally on the platform 12.

Once a book B has been placed on the platform 12 and the spring clamps 18, 20 placed in holding contact with the front and rear covers of the book, page hold-down means generally indicated at 34 is brought into releasable contact with the adjacent opened pages of the book near the bottom center thereof. More particularly such means includes a hold-down member 36 in the form of a triangular-shaped wire secured at its base by a central inwardly-extending pin 37 to an elongated narrow shaft 38 extending horizontally below the book-engaging flange 16 and carried in suitable bushings on opposite ends of the platform to permit both axial and rotative movement of the shaft, only one bushing 40 being shown in FIGS. 1 and 3. The pin 37 extends through a V-shaped slot 44 in a hollow cylindrical housing 46 centrally fixed to the platform 12 below the supported book B and coil springs 48, 49 compressed between the ends of the housing and the pin 37 on the shaft 38 resiliently urge the shaft to a centered position so that the pin 37 rises to the apex of the slot 44 as shown best in FIG. 4, thus to push the hold-down member 36 into engagement with the adjacent opened pages of the book B as shown in FIG. 1 and in phantom lines in FIG. 3. In addition, since the pin 37 extends through the V-shaped slot 44 in the housing 46 its pivotal motion brings the attached hold-down member 36 into the desired centered engagement with the adjacent opened pages of the book, it being notable that axial motion of the shaft 38 allows such centering.

In order to pivot the hold-down member 36 away from page contact temporarily and thus allow turning of a page, means are provided to move the shaft 38 axially to pull the hold-down member 36 laterally and through engagement of the pin 37 with the edges of the V-shaped slot 44 simultaneously effect pivotal motion of the hold-down member from the page-engaging position shown in FIG. 1 and in phantom lines in FIG. 3 to the pivoted release position shown in full lines in FIG. 3.

Such hold-down member release means includes a cam follower 50 mounted on a sleeve 51 slidably mounted on the shaft 38 near its right end so as to permit shaft rotation. A lug 53 on the interior of the sleeve engages a ring 52 secured to the shaft. A cam 54 on the lower end of a drive shaft 56 engages the cam follower 50 when the shaft 56 rotates in a clockwise direction to effect axial motion of the elongated hold-down shaft 38 thus to release the page hold-down member 36. The drive shaft 56 is mounted in spaced and aligned bearings 58, 60 mounted adjacent the right edge of the platform 12 and is connected through a gear reducer 62 to a small motor 64 mounted on the platform adjacent its upper right corner. The drive from the gear reducer 62 is unidirectional (counterclockwise as viewed in FIGS. 2 and 3), and when the motor 64 is deenergized, the drive shaft is free to rotate in the opposite direction.

A manual toggle switch 66 of any suitable type and conveniently located, when pressed, closes an electromagnetic relay 68 to connect the motor 64 to a suitable power source (eg. 110$^{v}$ AC) (not shown). The motor 64, when thus energized, rotates the drive shaft 56 thus to move the cam follower 50 and release the page hold-down member 36. Continued movement of the cam follower 50 causes contact of the shaft 38 with a normally closed limit switch 70 that opens the relay 68 to deenergize the motor 64. The coil spring 48 is then free to return the hold-down member 36 to its operative position, and the elongated shaft 38 to its original position. The cam 54 is pivotally mounted on the shaft 56 and held by a stop 72 against movement in one direction on the shaft 56 but releasably by a coil spring 74 in the opposite direction so it can ride over the cam follower as the shaft 38 moves to the left.

In accordance with a significant aspect of the present invention, the motor 64 and shaft 56 which effect release of the page hold-down member 36 also provide the power means for effecting the page-turning function. Thus the two operations can be precisely correlated.

The drive shaft 56, intermediate its length, has a tape reel 76 secured thereto and mounting on its exterior a movable member 78 having limited flexibility such as a short length (eg. 6 inches) of metal tape enabling winding on the reel 76 but extended projection from the reel through an opening in a fixed reel housing 80 toward the adjacent page of a book B on the platform 12, preferably at an angle of approximately 15 degrees as clearly shown in FIG. 2. At its extremity, the movable member 78 carries a friction tip 82 composed of rubber of the like.

When the motor 64 is energized, as previously described, the shaft 56 rotates to effect rotation of the attached reel 76 and projection of movable member 78 from the housing so that the friction tip 82 engages the book page to instigate turning thereof toward the position shown in FIG. 2. Because of the correlated release of the page hold-down member 36, such action can occur and return pivotal motion of the latter to its operative position completes the entire page-turning operation.

When the motor 64 is deenergized so that the unidirectional drive ceases, a recoil spring 84 connecting the reel 76 to the fixed housing 80 effects reverse rotation of the reel 76 and rewinding of the movable member 78 thereon.

A similar page-turning apparatus can be mounted at the left edge of the platform 12 and in the form of a mirror image of the unit described so that it can effect a re-turning of pages in corresponding fashion. Both apparatus include protective covers, indicated at 86 at the left of FIG. 1 and preferably also encompass a light bulb 88 whose output can be directed through a lateral opening in each cover 86 to illuminate the book pages.

Many modifications and/or alterations can be made in the described structure without departing from the spirit of the invention and the scope of the invention is to be indicated only by reference to the appended claims.

What is claimed is:

1. Apparatus for turning the pages of a book or the like which comprises a platform adapted to support a book thereon, a movable member having a frictional tip adapted to engage the surface of a book page, means for moving said movable member to frictionally engage and push the book page toward the opposite page of the book, page hold-down means normally but releasably urged into engagement with both of the adjacent pages of the book, means operative to release said page hold-down means from page engagement, and means connecting said member-moving means and said page hold-down means so that said latter means is released automatically to an inoperative position during movement of said member-moving means.

2. Apparatus for turning the pages of a book or the like according to claim 1 which comprises power means for moving said member-moving means and said page hold-down releasing means.

3. Apparatus for turning the pages of a book or the like according to claim 2 which comprises means for automatically deenergizing said power means after a page has been turned.

4. Apparatus for turning the pages of a book or the like according to claim 3 which comprises spring means for retracting said movable member when said power means has been deenergized.

5. Apparatus for turning the pages of a book or the like which comprises a platform adapted to support a book thereon, a first movable member mounted on said platform adjacent the right side thereof and having a frictional tip adapted to engage the right page on a book, a second movable member mounted on said platform adjacent the left side thereof and having a frictional tip adapted to engage the left page of a book, separate means for moving said first and second movable members, page hold-down means normally but releasably urged into engagement with both the right and left pages of the book, and means operative in response to operation of either of said separate moving means to effect release of said page hold-down means.

* * * * *